US006766902B1

(12) United States Patent
Hartelius

(10) Patent No.: US 6,766,902 B1
(45) Date of Patent: Jul. 27, 2004

(54) PREMIUM CONTAINER ON BEVERAGE CUP

(76) Inventor: Mark E. Hartelius, 8112 Komensky, Chicago, IL (US) 60652

( * ) Notice: Subject to any disclaimer, the term of this patent is extended or adjusted under 35 U.S.C. 154(b) by 0 days.

(21) Appl. No.: 10/666,951

(22) Filed: Sep. 18, 2003

Related U.S. Application Data

(60) Provisional application No. 60/412,636, filed on Sep. 18, 2002.

(51) Int. Cl.[7] ..... B65D 77/00

(52) U.S. Cl. ..... 206/217; 206/232; 206/457; 220/521

(58) Field of Search ..... 206/216, 217, 206/232, 457; 215/6, 227, 386, 387; 220/212, 521, 522, 23.83, 23.86, 23.88, 23.89

(56) References Cited

U.S. PATENT DOCUMENTS

| | | | | | |
|---|---|---|---|---|---|
| RE17,232 | E | | 3/1929 | Fitzgerald | |
| 3,433,378 | A | | 3/1969 | Ross | 215/6 |
| 3,624,787 | A | | 11/1971 | Newman | 220/60 |
| 3,743,520 | A | | 7/1973 | Croner | 99/171 B |
| 3,746,158 | A | * | 7/1973 | Connick | 220/522 |
| 3,768,688 | A | | 10/1973 | Linke | 220/23 |
| 4,007,936 | A | | 2/1977 | Hornsby, Jr. | |
| 4,883,935 | A | * | 11/1989 | Fairchild et al. | 220/23.83 |
| 5,439,103 | A | | 8/1995 | Howes | 206/217 |
| 5,674,546 | A | * | 10/1997 | Barnes et al. | 220/23.86 |
| 5,971,195 | A | | 10/1999 | Reidinger et al. | |
| 6,085,919 | A | * | 7/2000 | Singer | 206/217 |
| 6,196,411 | B1 | | 3/2001 | Nava et al. | 220/521 |
| 6,299,014 | B1 | | 10/2001 | Nava et al. | |
| 6,302,288 | B1 | | 10/2001 | Nava et al. | 220/212 |
| 2002/0144913 | A1 | | 10/2002 | Falkenberg | |

* cited by examiner

*Primary Examiner*—Luan K. Bui
(74) *Attorney, Agent, or Firm*—Robert W. J. Usher

(57) ABSTRACT

A container assembly for three dimensional premium item mounted removably to a beverage cup for handling as a single unit has a clear, plastic cover member, and first and second base members. The first base member is formed with a gift containing well which is closed by a clear flat top panel of the cover member by assembly of the first base member therein. The second base member releasably attaches to the bottom of the first base member to define a collectible card receiving compartment and has a flat topped bottom recess which can receive the top panel of another assembly to enable the container assemblies to be stably stacked on top of each other. The second base member is a press fit on the lid of a standard large beverage cup to releasably mount the container assembly thereon.

4 Claims, 2 Drawing Sheets

1
5
2
3
7
6
8
9
10
38
41
11
4
19
26
25
40
12
14
13
15
16
37
36

PREMIUM CONTAINER ON BEVERAGE CUP

RELATED APPLICATION

Priority is claimed from provisional application 60/412,636 filed Sep. 18, 2002, the disclosure of which is incorporated herein by reference

FIELD OF THE INVENTION

The present invention relates to containers for premium/promotional items or gifts presented to customers with a purchased item/at the point of purchase. The invention is particularly applicable to children and collectors who frequent 'fast food' restaurants.

BACKGROUND OF THE INVENTION

It is common for restaurants, especially fast food restaurants, to supply a gift or prize item to customers with a purchase as a way of adding value to the purchase. Such promotional gifts or premiums are, typically, licensed copyrighted characters intended to appeal to children.

In fast food restaurants, beverages are commonly dispensed in cups of waxed paper or plastic and a molded lid is removably affixed to the top of the cup to minimize spillage. Such beverage cups and lids are both disposable and stackable minimizing dispensing and storage costs. However, the gift items or premiums are typically packaged in polybags or boxes handed out separately from the beverage, which requires an additional, inconvenient handling step at the point of sale, significantly slowing dispensing time at busy periods. Furthermore, most of the packages are not readily stackable for compact storage and, typically are not of sufficiently low manufacturing cost to be consider the container economically disposable.

In an attempt to overcome the above disadvantage U.S. Pat. No. 6,302,288 issued in 2001 Nava teaches a container comprising a clear cover releasably assembled to a base to provide between them a closed receptacle for a premium toy figurine or model (such as a celebrity baseball player) with the assembly forming a lid for the beverage container mounting the toy thereon for handing over to the customer at the point of sale as a single item.

However, the containers are not adapted to be stacked on top of each other as required for compact storage and convenient handling prior to application to the filled beverage cup as, although the underside of the container is recessed, the cover is designed to protrude upwards in a bulky and irregular fashion following approximately the profile of the toy figurine, for maximum visibility thereof. In addition, in attempting to grasp the toy, a child must separate the cover and base which can result in inadvertent spillage as the container also seals the cup filled with beverage.

Furthermore, no provision is made for containing also a card describing the attributes of the celebrity which is desirably of coaster size. In fact, the prior patent teaches that a straw should extend through the cover and base of the container adjacent the receptacle for the figurine which would not be possible if such card were located in the cover as it would extend across the opening.

SUMMARY OF THE INVENTION

It Is an object of the invention to provide a container for a promotional or premium item which does not require to be handed to a customer separately from a purchased beverage but can be handed to the customer with a filled beverage cup as a single unit.

It is another object of the invention to provide a container for a promotional item which can be manufactured at low cost by conventional mass production techniques so as to be considered disposable.

It is a further object of the invention to provide containers for promotional items which containers can be readily stacked on each other for compact storage and convenient handling and dispensing.

A further object of the invention is to provide a container for a promotional item which provides a compartment accommodating a collectible printed card associated with the item.

An additional object of the invention is to provide a container for holding a gift or prize item wherein the item may be removed without disturbing the lid of the beverage cup.

According to one aspect, the invention provides a container for holding a gift item with a three dimensional or solid body which is mounted removably to a beverage cup for handling as a single unit, comprising a clear, plastic cover member molded as one piece with a flat, round top panel and a downwardly divergent tubular side wall depending from a peripheral edge thereof; a first plastic base member molded as one piece with a round, upper panel and a downwardly divergent tubular side wall depending from a peripheral edge thereof, the upper panel being formed with a well containing the gift item entirely therein; means extending around respective lower peripheries of the respective side walls of the cover member and first base member, interengagable as a press fit, for releasably assembling the cover member and the base member together with the base member well received inside the cover in telescoped relation and with the top panel of the cover extending across the well so that the cover member and the first base member provide between them a closed receptacle for the gift item; and, a further base member having a round panel formed with a card receiving recess and means on a periphery of the further base member interengagable as a press fit with the first base member for releasably retaining the further base member assembled to a bottom of the first base member to provide a card receiving compartment between a bottom of the well and the panel of the base member and interengagable as a press fit with a rim of a lid of a beverage cup to mount the container releasably thereon.

Preferably, the means for retaining the card in the recess are integrally formed on the further base member and, the card retaining means comprise a plurality of undercut detents at a perimeter of the recess enabling the card to be inserted into the recess in a snap action.

It is further preferred that, the means for releasably retaining the further base member on the beverage cup is formed on a flange which depends from a periphery of the panel of the further base member snap and forms with the panel a flat topped stacking recess receiving the top panel of a cover member of another container assembly to in stacking relation.

BRIEF DESCRIPTION OF THE DRAWINGS

In order that the invention may be readily understood, specific embodiments thereof will now be described by way of example only and with reference to the accompanying drawings in which.

PARTICULAR DESCRIPTION

Figures 1, 2:
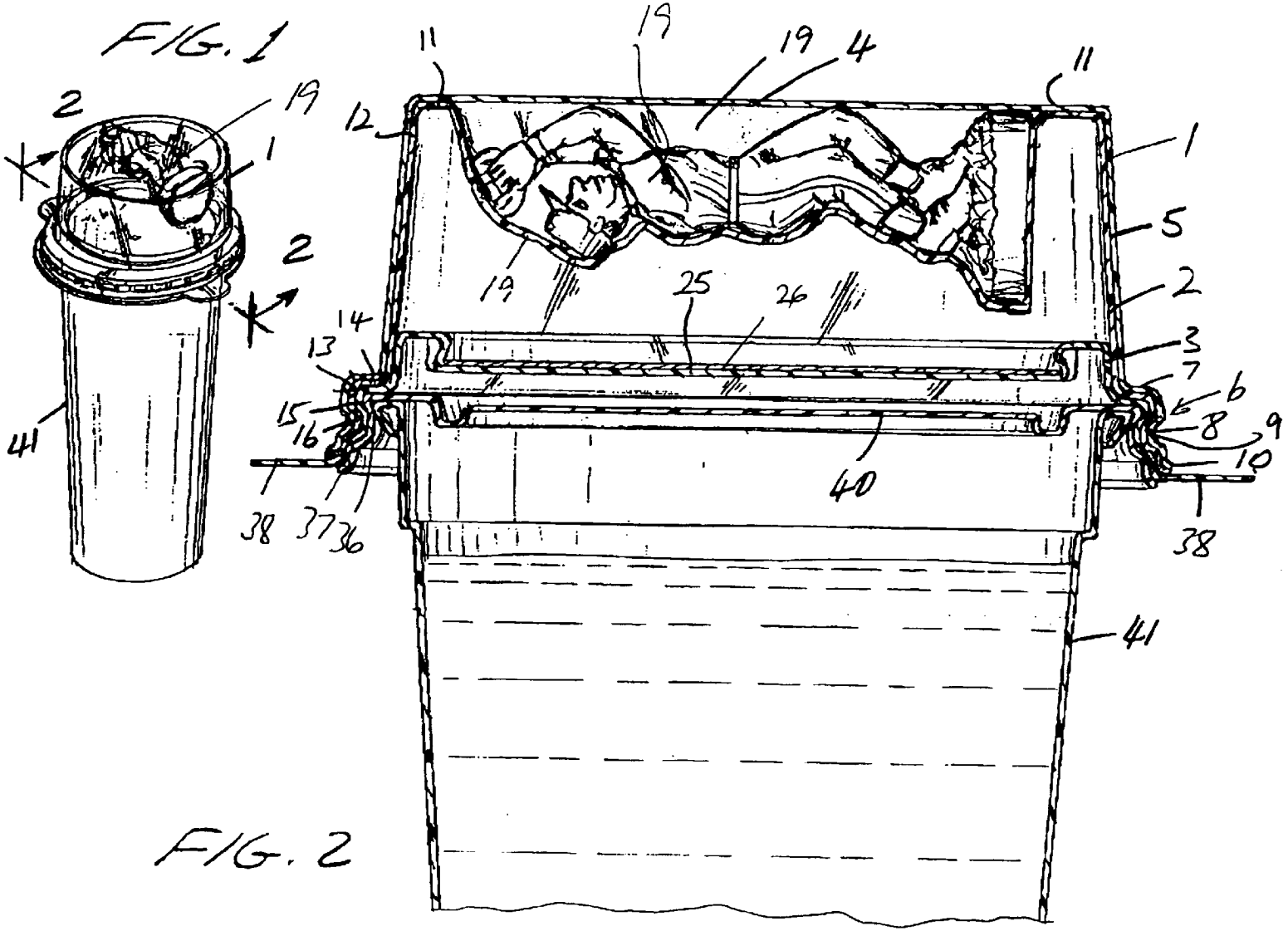
FIG. 1 is a perspective view of the gift container according to the invention mounted on a filled beverage cup.
FIG. 2 is a cross-sectional view along lines 2—2 of FIG. 1.

The container comprises a top cover member 1, a first base member 2 and a second base member 3, each vacuum molded in one piece from suitable transparent plastic such as PTE.

The cover member has a flat circular top panel wall 4 and a gently divergent tubular, frustoconical, sidewall portion 5 depending from the perimeter thereof and terminating in a peripheral retaining flange 6 having a first portion 7 initially extending radially outward forming a shoulder, and a second portion 8 extending downward from a free edge of the shoulder and formed with a ring of retaining indents 9 and terminating at an open bottom edge in a slight out-turned lip 10.

The first base member 2 also comprises a flat circular top panel wall 11 and a gently divergent, frustoconical, tubular sidewall portion 12 depending the perimeter thereof and terminating in a peripheral retaining flange 13 matching the flange of the cover member, with a radially outwardly extending shoulder 14, a downward portion 15 formed with a ring of retaining indents 16 for mating with the detent sides of indents 9 of the cover member and, terminating at an open bottom edge in a slight out-turned lip 17. A well 19 is formed in the top panel 11 and shaped to receive and contain a figure of a celebrity baseball character 19, retaining the figure in a desired position for display through the top panel of the cover. Portions 21 of opposite longitudinal sidewalls of the well are depressed inwardly adjacent the mouth of the well forming in effect a figure retaining undercut or constriction passed which the figure must be pushed with a snap action for receipt and retention in the well.

The second or further base member 3 comprises a flat horizontal panel 23 formed with a peripheral circular ridge 24 defining a central recess 25 for receiving a circular, printed collectable card 26, card retaining detents 27 extending inward from opposite diametrical locations to overlie the central recess sides. The detents 27 have inclined upper lead in surfaces 28 and undercuts 29 enabling the card 30 to be pushed into the central recess over-riding the card retaining detents with a snap action and retained by opposite edges being received in the undercuts 29.

A retaining flange 33 matching the flange 13 of the first base member 2, extends from the periphery of the panel 23 and has a radially outwardly extending shoulder 34, a downward portion 35 formed with a ring of retaining indents 36 for mating with the detent sides of indents 16 of the second base member and, terminating at an open bottom edge in a slight out-turned lip 37 from respective opposite diametrical locations of which pull tabs 38 extend radially outward, defining with the panel 23 a flat topped recess on the underside of the second base member.

In assembling the container, the figurine is press fit into the well of the first base member which is then telescoped inside the cover member until the respective detents/indents thereof engage in a press fit securing the cover to the first base member with the figurine of the celebrity baseball player display prominently in fixed position behind the top panel of the cover. The card is then snap fitted into the central recess of the central panel of the second base member which is then inserted into an underside of the first base member with their detents/indents engaging as press fits.

Figures 3, 4:
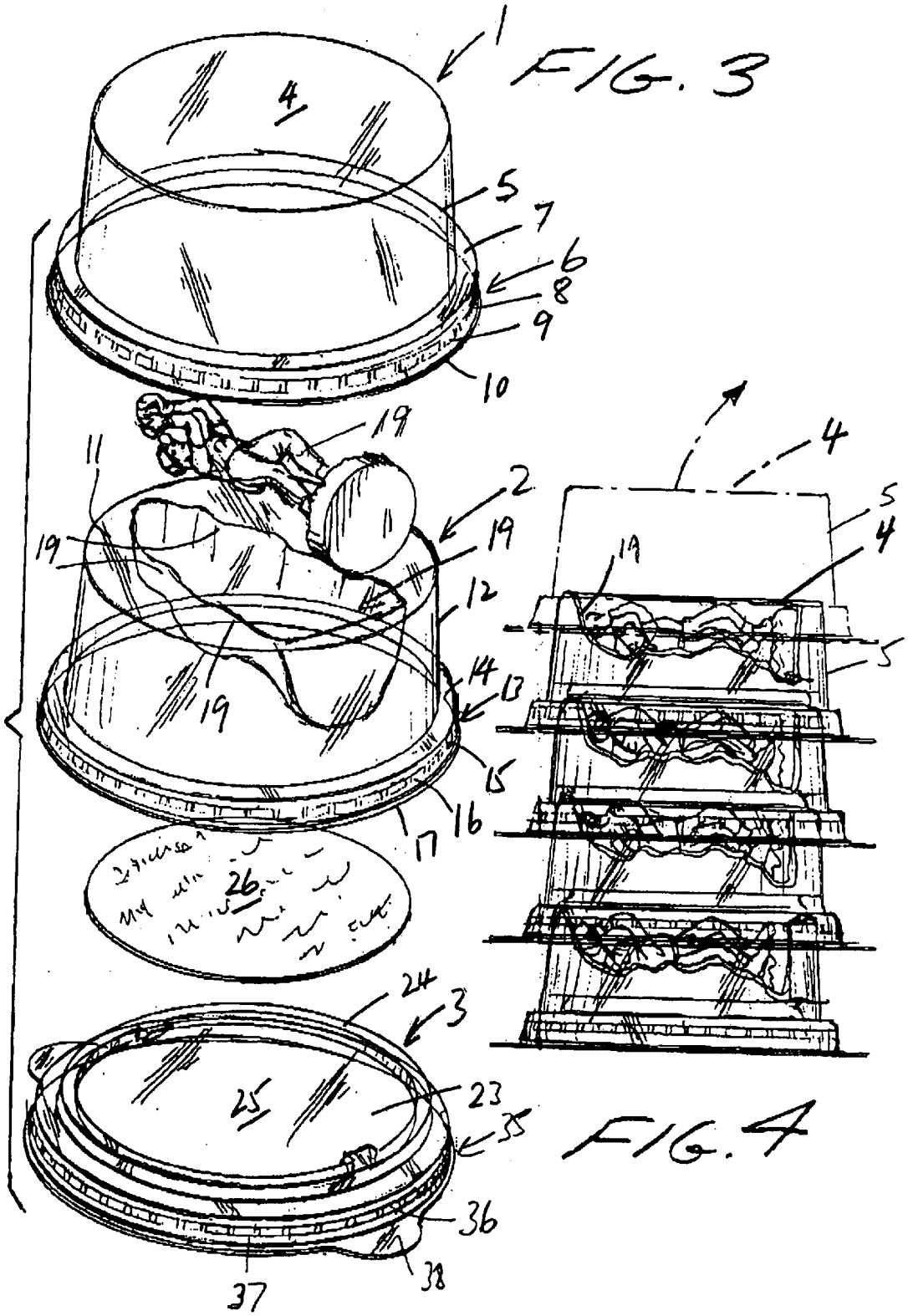
FIG. 3 is an exploded view of the container according to the invention.
FIG. 4 is a schematic elevational view of several containers stacked one on top of another.

As a result of the flat top panel 4 of the cover member and flat topped, recessed underside of the second base member, and frusto-conical shape of the container assembly, the container assemblies can form a stable counter stack, as shown in FIG. 4, from which they can be readily dispensed, on by one, by hand and press fitted by engagement of detent sides of indents 38 with the rim of a conventional lid 40 of a cup 41 filled with beverage, without risk of spillage.

A child can easily remove the container assembly from the lidded beverage cup by pulling on a tab without risk of spillage of beverage as the lid remains on the beverage cup.

The premium items can include solid bodies such as figurines of baseball/football characters, games or toys or collectable cards, game cards or puzzle cards.

The transparency of the receptacle panel enables the contained item to be seen by the consumer or vendor, enabling a particular premium item to be selected to complete a collector's set of such items.

What is claimed is:

1. A container for holding a gift item with a three dimensional or solid body which is mounted removably to a beverage cup for handling as a single unit, comprising a clear, plastic cover member molded as one piece with a flat, round top panel and a downwardly divergent tubular side wall depending from a peripheral edge thereof;

a first plastic base member molded as one piece with a round, upper panel and a downwardly divergent tubular side wall depending from a peripheral edge thereof, the upper panel being formed with a well containing the gift item entirely therein;

means extending around respective lower peripheries of the respective side walls of the cover member and first base member, interengagable as a press fit, for releasably assembling the cover member and the base member together with the base member well received inside the cover in telescoped relation and with the top panel of the cover extending across the well so that the cover member and the first base member provide between them a closed receptacle for the gift item; and, a further base member having a round panel formed with a card receiving recess and means on a periphery of the further base member interengagable as a press fit with the first base member for releasably retaining the further base member assembled to a bottom of the first base member to provide a card receiving compartment between a bottom of the well and the panel of the base member and interengagable as a press fit with a rim of a lid of a beverage cup to mount the container releasably thereon.

2. A container according to claim 1 wherein means for retaining the card in the recess are integrally formed on the further base member.

3. A container according to claim 2 wherein the card retaining means comprise a plurality of undercut detents at a perimeter of the recess enabling the card to be inserted into the recess in a snap action.

4. A container according to claim 2 wherein the means for releasably retaining the further base member on the beverage cup is formed on a flange which depends from a periphery of the panel of the further base member snap and forms with the panel a flat topped stacking recess receiving the top panel of a cover member of another container assembly in stacking relation.

* * * * *